United States Patent [19]

Yamamoto et al.

[11] Patent Number: 4,838,033

[45] Date of Patent: Jun. 13, 1989

[54] HEAT INSULATING SUPPORT DEVICE FOR CRYOGENIC EQUIPMENT

[75] Inventors: Yuuichi Yamamoto; Tadaaki Nakamura; Takashi Murai; Akemi Hijikata, all of Kobe, Japan

[73] Assignee: Mitsubishi Denki Kabushiki Kaisha, Japan

[21] Appl. No.: 163,128

[22] Filed: Feb. 19, 1988

Related U.S. Application Data

[63] Continuation of Ser. No. 910,641, Sep. 23, 1986, abandoned.

[30] Foreign Application Priority Data

Sep. 24, 1985 [JP] Japan ..... 60-211571
Mar. 27, 1986 [JP] Japan ..... 61-67195

[51] Int. Cl.[4] ..... F17C 1/00

[52] U.S. Cl. ..... 62/45.1; 62/51.1; 248/613; 248/DIG. 1

[58] Field of Search ..... 62/514 R, 45; 248/DIG. 1, 613

[56] References Cited

U.S. PATENT DOCUMENTS

| | | | |
|---|---|---|---|
| 2,421,822 | 6/1947 | Wood | 248/613 X |
| 3,814,361 | 6/1974 | Gabron et al. | 62/45 X |
| 4,526,015 | 7/1985 | Laskaris | 62/514 R |
| 4,613,119 | 9/1986 | Hardtke | 248/613 X |

FOREIGN PATENT DOCUMENTS

| | | | |
|---|---|---|---|
| 2568350 | 1/1986 | France | 62/45 |

OTHER PUBLICATIONS

"Advance in Cryogenic Engineering", Fast, vol. 27, Plenum Press, New York and London, 1982.

*Primary Examiner*—Ronald C. Cappossela
*Attorney, Agent, or Firm*—Leydig, Voit & Mayer

[57] ABSTRACT

An improved heat-insulating support device is disclosed which is capable of supporting a coolant tank to a vacuum vessel in a manner such that when the vacuum tank is subjected to a great external force after the coolant tank has been cooled down to a cryogenic temperature, the coolant tank and hence cryogenic equipment mounted thereon are held in place and prevented from being displaced beyond a prescribed allowable range, without impairing the intended heat-insulating capability thereof. The heat-insulating support device comprises a heat insulating support member disposed outside the coolant tank with one end connected with the coolant tank; a mounting rod having one end connected with the heat-insulating support member and its other end projected outwardly through the vacuum vessel; and a spring for resiliently mounting the other projected end portion of the mounting rod on the vacuum vessel, the spring having a non-linear spring characteristic including a small spring constant for mainly absorbing thermal contraction of the coolant tank and a large spring constant for mainly suppressing displacement of the coolant tank due to large external forces acting thereon after the thermal contraction of the coolant tank.

15 Claims, 4 Drawing Sheets

HEAT INSULATING SUPPORT DEVICE FOR CRYOGENIC EQUIPMENT

This application is a continuation of application Ser. No. 910,641, filed Sept. 23, 1986 now abandoned.

BACKGROUND OF THE INVENTION

1. Field of the Invention

The present invention relates to a heat-insulating support device for cryogenic equipment, and more particularly, to such a heat-insulating support device which is adapted to be used at cryogenic temperatures.

2. Description of the Prior Art

In the past, there have hitherto been known conventional heat-insulating support devices for cryogenic equipment such as that described in the publication entitled "ADVANCES IN CRYOGENIC ENGINEERING", volume 27, in a chapter titled "MANUFACTURE OF A 6-m SUPERCONDUCTING SOLENOID INDIRECTLY COOLED BY SUPERCRITICAL HELIUM", on pages 109 to 117, published by Plenum Press, New York and London. FIGS. 6 and 7 illustrate such a conventional heat-insulating support device of a cryostat for use with superconducting machine, where FIG. 6 is a schematic cross sectional view of the cryostat and FIG. 7 is an enlarged cross sectional view of a heat-insulating support device of the cryostat shown in FIG. 6.

In FIG. 6, there is schematically shown a cryostat for superconducting machine which comprises a coolant tank 3, a superconducting coil 1 disposed in a coolant tank 3, a coolant 2 such as liquid helium stored in the coolant tank 3 for cooling the superconducting coil 1, a vacuum vessel 4 housing therein the coolant tank 3 for vacuum shielding the coolant tank 3, and a plurality of heat-insulating support means S for supporting the coolant tank 3 to the vacuum vessel 4 in a heat-insulating manner.

As clearly shown in FIG. 7, each of the heat-insulating support means S comprises a bracket 5 fixedly secured to the side wall of the coolant tank 3, a mounting rod 6 mounted on the side wall of the vacuum vessel 4, and a heat-insulating support member 7 formed of a heat insulating material and connected at its one end with the bracket 5 and at its other end with the mounting rod 6. The mounting rod 6 is formed at its one end with an enlarged socket **6*a* in which the adjacent end of the support member 7 is received and connected thereto as by a pin 6*b*, and at its other end with a screw thread 6*c* through which the mounting rod 6 is mounted on the vacuum vessel 4 in the following manner. Specifically, the vacuum vessel 4 has a plurality of annular outward projections 4*a* formed at its side wall, each of the outward projections 4*a* having a throughhole 4*b* which is hermetically closed by a closure member 8. Mounted on the outer surface of the closure member 8 is a spring housing 9 in which a spring means 10 in the form of axially disposed belleville springs having a linear spring characteristic is received. The socket end 6*a* of the mounting rod 6 is disposed in the throughhole 4*b* in the vacuum vessel 4 with its threaded end 6*c* extending outward through the closure member 8 and the bottom 9*a* of the spring housing 9. Slidably fitted on the mounting rod 6 is a presser member 11 which has a sleeve 11*a* and a flange 11*b* integrally formed with each other. An adjusting nut 12 is threadedly engaged with the threaded end 6*c* of the mounting rod 6 and abuts at its one side against the flange 11*b* of the presser member 11 so that the mounting rod 6 is connected with the closure member 8 through the nut 12, the presser member 11, the belleville springs 10 and the spring housing 9. By turning the adjusting nut 12 in a tightening or loosening direction, the presser member 11 is caused to displace axially so as to compress the belleville springs 10 or permit them to expand whereby the resilient force of the belleville springs 10 can be adjusted in an appropriate manner. A dust cover 13 is attached to the closure member 8** for protecting the heat-insulating support device S from the outside.

Reference numerals 14 and 15 designate an O ring disposed between the closure member 8 and the outer peripheral surface of the mounting rod 6 and another O ring disposed between the outer surface of the projection **4*a* on the vacuum vessel 4 and the inner surface of the closure member 8, respectively, for hermetically sealing the interior of the vacuum vessel 4** from the outside.

In the above-described manner, the superconducting coil 1 is fixedly mounted on the bottom of the coolant tank 3 which is, in turn, supported by the vacuum vessel 4 through the heat-insulating support means S. With this construction, the coolant tank 3 is at room temperature when no coolant is stored therein, but cooled down to a cryogenic temperature of about 4.2° K. (−269° C.) when supplied with a cryogenic coolant 2 such as liquid helium so that it is subjected to tremendous thermal contraction. Due to such thermal contraction of the coolant tank 3, there will arise a great tensile force acting between the heat-insulating support member 7 and the mounting rod 6, which is to be absorbed by means of the belleville spring 10. On the other hand, the belleville spring 10 is given an appropriate amount of tension such that it can prevent any slight displacement of the coolant tank 3 due to relatively limited external forces acting on the vacuum vessel 4. Also, by turning the adjusting nut 12, the coolant tank 3 can be displaced relative to the vacuum vessel 4 whereby the position of the superconducting coil 1 can be adjusted in an appropriate manner.

With the conventional heat-insulating support device as constructed in the above manner, however, the preset position of the superconducting coil 1 tends to be displaced considerably beyond an allowable range by a great force such as an eccentric electromagnetic force acting on the coolant tank 3. In order to prevent such a situation, it is considered that the spring constant of the spring 10 be made greater so as to reduce the amount of displacement of the coolant tank 3 to be within a prescribed allowable range. In this case, however, it is difficult to absorb the tensile force created by the thermal contraction of the coolant tank 3 and therefore it is necessary to increase the cross sectional area of the heat-insulating support member 7 and the mounting rod 6 for improved mechanical strength. As a result, the amount of heat transferred from the vacuum vessel 4 of room temperature toward the coolant tank 3 through the mounting rod 6 and the heat-insulating support member 7 increases, thus deteriorating the heat-insulating capability thereof.

SUMMARY OF THE INVENTION

In view of the above, the present invention is intended to obviate the above-described problems of the prior art and has for its object the provision of a novel and improved heat-insulating support device of the character described above which is capable of supporting a coolant tank to a vacuum vessel in such a manner that when the vacuum tank is subjected to large external forces after the coolant tank has been cooled down to a cryogenic temperature, the coolant tank and hence cryogenic equipment mounted thereon are held in place and prevented from being displaced beyond a prescribed allowable range, without impairing the intended heat-insulating capability thereof.

In order to achieve the above object, according to the present invention, there is provided a heat-insulating support device for supporting a coolant tank to a vacuum vessel in a heat insulating manner, the coolant tank being adapted to store a cryogenic coolant and subject to thermal contraction upon cryogenic cooling thereof as well as being subject to large external forces after the cryogenic cooling, the device comprising:

a heat insulating support member disposed outside the coolant tank and having its one end connected with the coolant tank;

a mounting rod having its one end connected with the heat-insulating support member and its other end projected outwardly through the vacuum vessel; and a spring means for resiliently mounting the other projected end portion of the mounting rod on the vacuum vessel, the spring means having a non-linear spring characteristic including a small spring constant for mainly absorbing thermal contraction of the coolant tank and a large spring constant for mainly suppressing a displacement of the coolant tank due to large external forces acting thereon after the thermal contraction of the coolant tank.

In one embodiment, the spring means comprises a first spring means of a low spring constant and a second spring means of a high spring constant connected in series with each other.

In another embodiment, the first spring means comprises belleville springs, and the second spring means comprises belleville springs having a spring constant larger than that of the first-mentioned belleville springs.

In a further embodiment, the first spring means comprises single-row belleville springs, and the second spring means comprises multiple-row belleville springs having a spring constant larger than that of the single-row belleville springs, the multiple-row belleville springs including a plurality of bellville springs disposed in a parallel relation with each other.

In a still further embodiment, the first spring means comprises a coil spring, and the second spring means comprises belleville springs having a spring constant larger than that of the coil spring.

In a yet further embodiment, the first spring means comprises a first coil spring, and the second spring means comprises a second coil spring having a spring constant larger than that of the first coil spring.

In a further embodiment, the first spring means comprises single-row coil springs, and the second spring means comprises miltiple-row coil springs having a spring constant larger than that of the single-row coil springs, the multiple-row coil springs including a plurality of coil springs disposed in a parallel relation with each other.

The first and second spring means may comprise the same kind of springs having different spring constants.

The first and second spring means may comprise different kinds of springs having different spring constants.

In a further embodiment, the spring means comprises a first spring means of a low spring constant and a second spring means of a high spring constant connected in parallel with each other such that after the first spring means has been compressed to a prescribed extent, the second spring means begins to be compressed.

In accordance with a preferred embodiment, there is provided a heat-insulating support device for supporting a coolant tank to a vacuum vessel in a heat insulating manner, the coolant tank being adapted to store a cryogenic coolant and subject to thermal contraction upon cryogenic cooling thereof as well as being subject to large external forces after the cryogenic cooling, the device comprising:

a heat insulating support member disposed outside the coolant tank and having its one end connected with the coolant tank;

a mounting rod having its one end connected with the heat-insulating support member and its other end projected outwardly through the vacuum vessel;

a presser member slidably mounted on the mounting rod;

a spring means disposed between the vacuum vessel and the presser member for resiliently mounting the other projected end portion of the mounting rod on the vacuum vessel, the spring means having a non-linear spring characteristic including a small spring constant for mainly absorbing thermal contraction of the coolant tank and a large spring constant for mainly suppressing displacement of the coolant tank due to large external forces acting thereon after the thermal contraction of the coolant tank; and an adjusting nut disposed outwardly of the presser member and threadedly engaged with the other projected end portion of the mounting rod for adjusting an initial load of the spring means.

In this embodiment, the vacuum vessel may be provided on its outer surface with an outward projection which has a throughhole through which the other end of the mounting rod extends outward, the device further comprising:

a closure member attached to the vacuum vessel for closing the throughhole; and a spring housing mounted on the closure member for receiving therein the spring means.

In accordance with another preferred embodiment, there is provided a heat-insulating support device for supporting a coolant tank to a vacuum vessel in a heat insulating manner, the coolant tank being adapted to store a cryogenic coolant and subject to thermal contraction upon cryogenic cooling thereof as well as being subject to large external forces after the cryogenic cooling, the device comprising:

a heat insulating support member disposed outside the coolant tank and having its one end connected with the coolant tank;

a mounting rod having its one end connected with the heat-insulating support member and its other end projected outwardly through the vacuum vessel;

a first presser member slidably mounted on the mounting rod;

a first spring means disposed between the vacuum vessel and the first presser member for resiliently mounting the other projected end portion of the mounting rod on the vacuum vessel for absorbing thermal contraction of the coolant tank;

an adjusting nut disposed outwardly of the presser member and threadedly engaged with the other projected end portion of the mounting rod for adjusting an initial load of the first spring means;

a second presser member mounted on the first presser member for limited sliding movement relative thereto; and a second spring means disposed between the vacuum vessel and the second presser member for suppressing, in cooperation with the first spring means, displacement of the coolant tank due to large external forces acting thereon after the thermal contraction of the coolant tank.

In this embodiment, the vacuum vessel may be provided on its outer surface with an outward projection which has a throughhole through which the other end of the mounting rod extends outward, the first presser member having a stepped cylindrical portion with a small-diameter section and a large-diameter section with a stepped shoulder defined therebetween, the device further comprising:

a closure member attached to the vacuum vessel for closing the throughhole and having an annular projection formed on its outer surface in a face-to-face relation with the small-diameter section of the stepped cylindrical portion of the first presser member, the annular projection having an outside diameter substantially equal to that of the small-diameter section;

an adjusting ring slidably mounted over the annular projection on the closure member and the small-diameter section of the stepped cylindrical portion of the first presser member, the adjusting ring having a threaded radially outer surface on which the second presser member in the form of an annular ring is threadedly engaged; and an adjusting bolt means for adjustably securing the second presser member to the closure member in a manner such that the second presser member is movable toward the closure member but prevented from movement away from the closure member, the adjusting bolt means serving to adjust an initial load of the second spring means;

whereby by turning the adjusting ring relative to the second presser member, a clearance between one end of the second presser member and the stepped shoulder on the stepped cylindrical portion of the first presser member can be appropriately adjusted.

In this embodiment, the second spring means may have a spring constant greater than that of the first spring means.

The above and other objects, features and advantages of the present invention will become apparent from the following detailed description of several presently preferred embodiments of the invention when taken in conjunction with the accompanying drawings.

DESCRIPTION OF THE PREFERRED EMBODIMENTS

Figure 6:
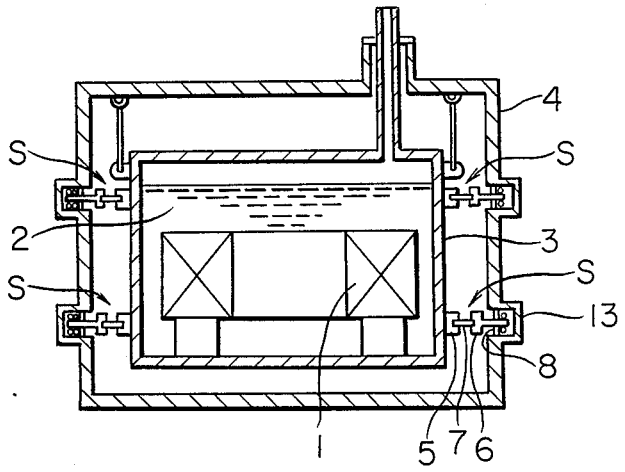
FIG. 6 PRIOR ART
FIG. 6 is a cross sectional side view of a cryostat having a conventional heat-insulating support device.
Figure 7:
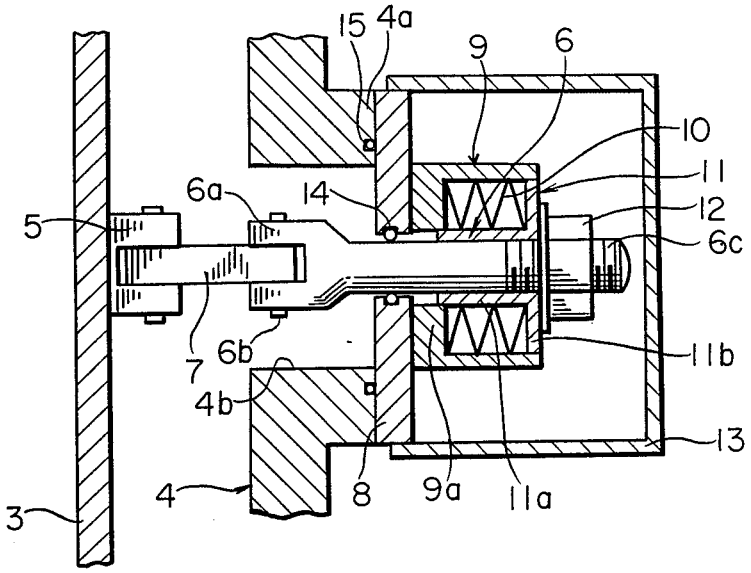
FIG. 7 PRIOR ART
FIG. 7 is an enlarged cross sectional view of the conventional heat-insulating support device shown in FIG. 6.

Now, the present invention will be described in detail with reference to several presently preferred embodiments thereof as illustrated in the accompanying drawings. In the following description, the same or corresponding parts of the illustrated embodiments of the invention will be identified by the same reference numerals and characters as employed in FIGS. 6 and 7.

Figure 1:
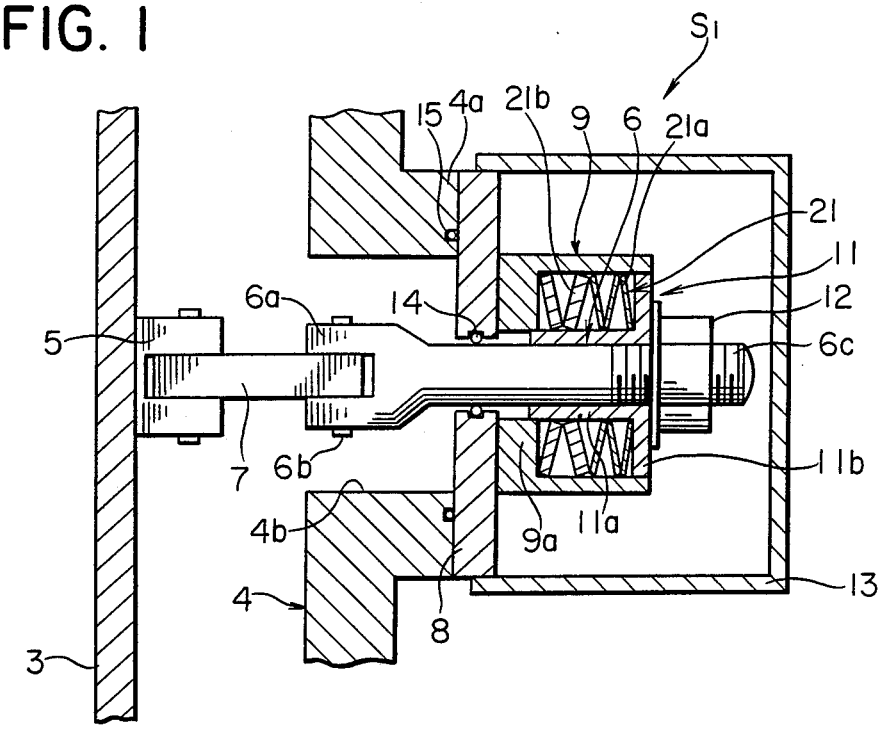
FIG. 1 is a cross sectional view of a heat-insulating support device for cryogenic equipment in accordance with a first embodiment of the present invention.

FIG. 1 shows a heat-insulating support device in accordance with a first embodiment of the present invention. In this figure, the component parts of this embodiment other than a spring means 21 are identical to those shown in FIG. 7.

Figure 4:
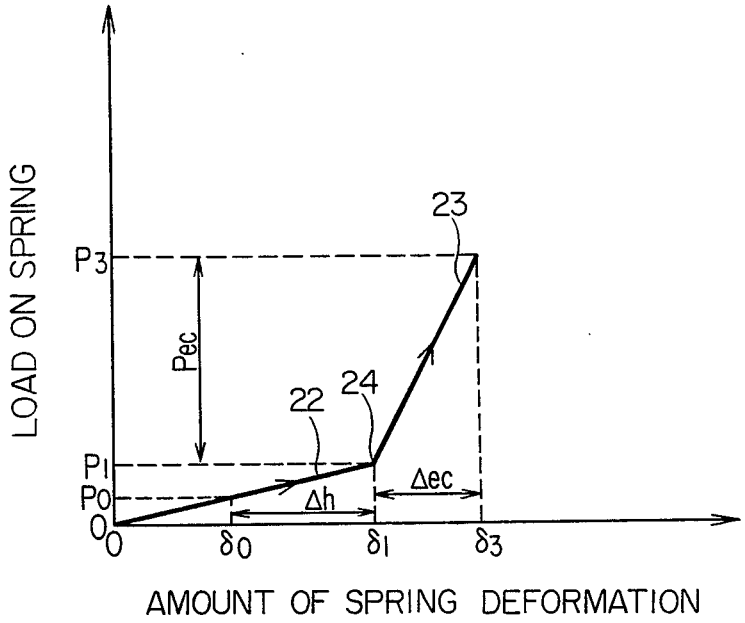
FIG. 4 is a graphic representation showing a relationship between the amount of deformation of spring means and the load applied to the spring means.

According to the present invention, the spring means 21 has a non-linear spring characteristic as shown in FIG. 4, in which the abscissa represents the amount of deformation of the spring means 21 and the ordinate represents the load imposed on the spring means 21. More specifically, the spring means 21 comprises a first spring means 21*a* of a small spring constant in the form of weak belleville springs and a second spring means 21*b* of a large spring constant in the form of strong belleville springs disposed axially in a series relation with the first spring means 21*a*.

As illustrated in FIG. 4, the spring means 21 has a first relatively low spring constant $k_1$ represented by a line 22 of a relatively small gradient and a second relatively high spring constant $k_3$ represented by a line 23 of a relatively large gradient.

In FIG. 4, $P_o$ represents an initial tensile force acting on the heat-insulating support member 7 and the mounting rod 6 which are mounted in place between the coolant tank 3 and the vacuum vessel 4; $\delta_0$ the amount of deformation of the spring means 21 due to the initial tensile force; $\Delta h$ the amount of thermal contraction of the coolant tank 3; $P_1$ the load applied to the spring means 21 after the thermal contraction of the coolant tank 3; $\delta_1$ the amount of deformation of the spring means 21 after the thermal contraction of the coolant tank 3; $\Delta Pec$ external forces acting on the coolant tank 3 after the thermal contraction thereof; $\Delta Pec$ the amount of deformation of the spring means 21 due to the external forces Pec; $P_3$ the load imposed on the spring means 21 when the external forces are applied to the coolant tank 3; and $\delta_3$ the amount of the deformation of the spring means 21 when the external forces are applied to the coolant tank 3.

In this regard, the second greater spring constant $k_3$ is determined relative to the amount of allowable displacement $\Delta a$ of the coolant tank 3 after its thermal contraction in the following manner.

$$\Delta ec = Pec/k_3 \leqq \Delta a$$

On the other hand, the first smaller spring constant $k_1$ is determined such that the smallest possible tensile force is obtainable when the heat-insulating support member 7 and the mounting rod 6 are mounted in place between the coolant tank 3 and the vacuum vessel 4 while taking up any slack therebetween.

Upon mounting the coolant tank 3 to the vacuum vessel 4 through the heat-insulating support device $S_1$ of this embodiment, the spring means 21 is first deformed in a range of the smaller spring constant while leaving the prescribed amount of thermal contraction Δh of the coolant tank 3 to be caused upon cryogenic cooling thereof so that an appropriate initial tensile force Po can be applied to the heat-insulating support member 7 and the mounting rod 6, thus taking up any slack therebetween. In this state, when the coolant tank 3 is cooled as by a cryogenic coolant such as liquid helium, there will be a tensile force created between the coolant tank 3 and the vacuum vessel 4 which, however, is limited because the small spring constant of the spring means 21 is in effect.

After the thermal contraction of the coolant tank 3, the deformation of the spring means 21 in the range of the small spring constant is completed and hence the coolant tank 3 is supported to the vacuum vessel 4 through the intermediary of the heat-insulating support member 7 and the mounting rod 6 under the action of the spring means 21 which has the greater spring constant now in effect. As a result, even if large external forces such as eccentric electromagnetic forces or the like act on the coolant tank 3 after thermal contraction thereof, it can be securely supported by the spring means 21 of the now greater spring constant so that the displacement of the coolant tank 3 will be suppressed within the prescribed amount of allowable displacement Δa.

Figure 2:
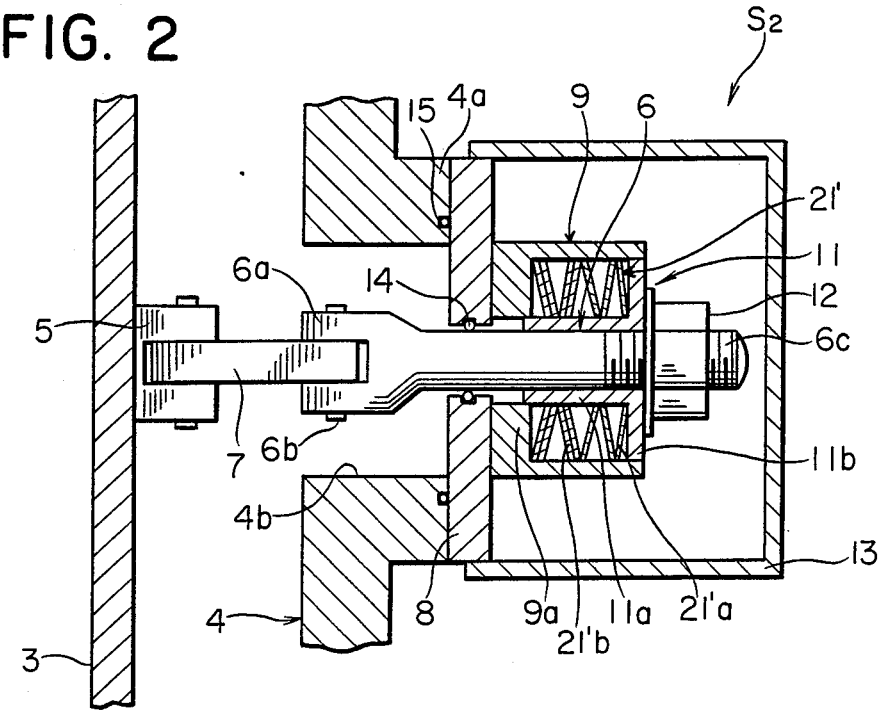
FIGS. 2 and 3 are cross sectional views similar to FIG. 1, respectively showing two other different embodiments of the present invention.
Figure 3:
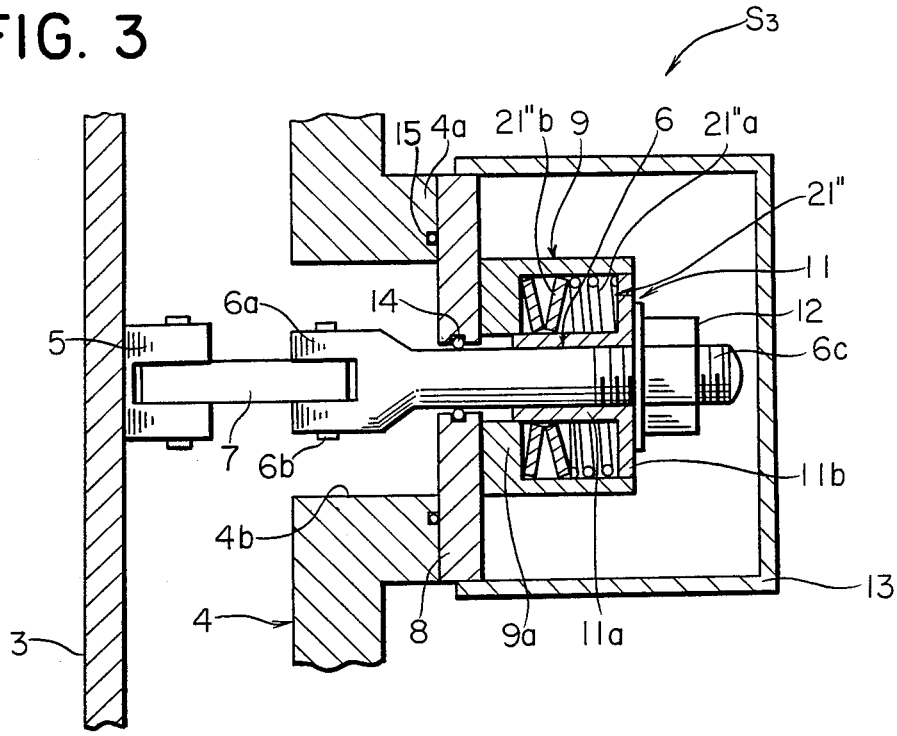

FIGS. 2 and 3 show two modified forms of the present invention, respectively. In FIG. 2, the spring means 21' comprises a first spring means **21'*a* of a small spring constant in the form of single-row belleville springs and a second spring means 21'*b* of a large spring constant in the form of double-row belleville springs connected in series with the single-row belleville springs 21'*a*. Each of the double-row belleville springs 21'*b* comprises two or more (two in FIG. 2**) belleville springs disposed in parallel or superposed one over another and hence they have a spring constant two or more times greater than that of the single-row belleville springs.

In FIG. 3, the spring means 21'' comprises a first spring means **21''*a* of a small spring constant in the form of a coil spring and a second spring means 21''*b* of a large spring constant in the form of belleville springs connected in series with the coil spring 21''*a***.

The construction and arrangement of the above-described embodiments illustrated in FIGS. 2 and 3 other than the spring means 21' or 21'' are the same as those in the first-mentioned embodiment illustrated in FIG. 1, and the operation of the spring means 21' or 21'' is similar to that of the spring means 21 in FIG. 1.

Further, though not illustrated, the following modifications of the spring means can be considered. Namely, the spring means may comprise a first spring means and a second spring means which are formed of the same kind of springs having different spring constants. Thus, for example, the first spring means comprises a first coil spring, and the second spring means comprises a second coil spring having a spring constant larger than that of the first coil spring. Also, the first spring means may comprise a single-row coil spring, and the second spring means may comprise multiple-row coil springs having a spring constant larger than that of the single-row coil spring, the multiple-row coil springs including a plurality of coil springs disposed in a parallel relation with each other. On the other hand, as referred to above, the spring means may comprise first and second spring means formed of different kinds of springs having different spring constants.

Figure 5:
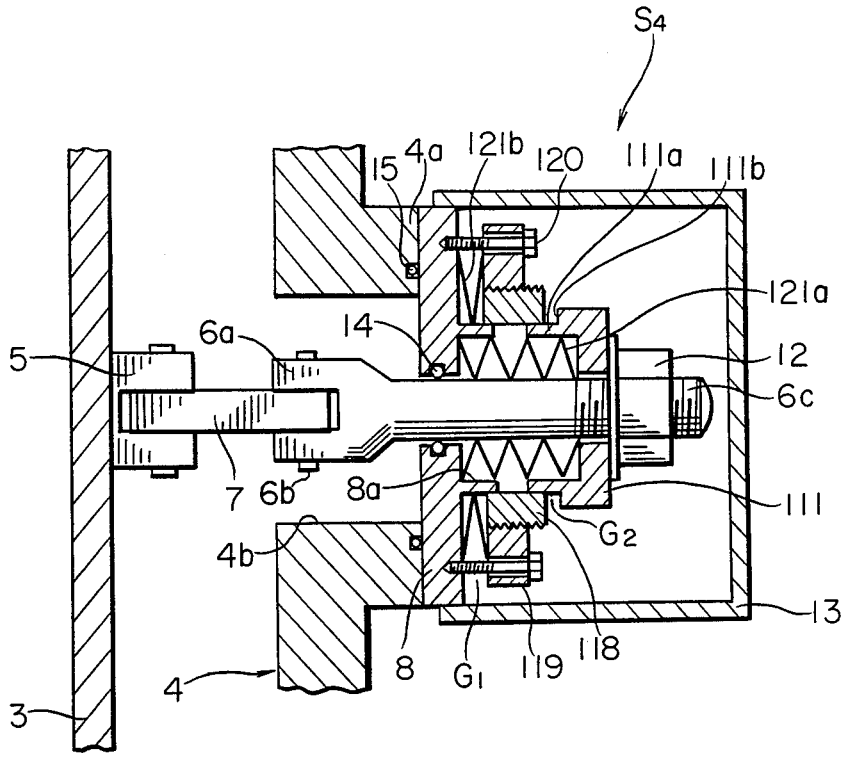
FIG. 5 is a cross sectional view similar to FIG. 1, showing a further embodiment of the present invention.

FIG. 5 shows a further embodiment of the present invention in which the spring means comprises a first spring means **121*a* and a second spring means 121*b*** arranged in parallel relation with each other.

Specifically, the first spring means **121*a* such as belleville springs, a coil spring or the like is disposed under compression around a mounting rod 6 between a closure member 8 attached to an annular projection 4*a* on the vacuum vessel 4 and a first presser member 111 in the form of a bottomed cylinder which is slidably fitted on a threaded end portion 6*c* of a mounting rod 6 but held against movement away from the closure member 8 by means of an adjusting nut 12 threaded on the outer end 6*a* of the mounting rod 6. The first cylindrical presser member 111 has a stepped cylindrical portion 111*a* including a small-diameter section and a large-diameter section with an annular stepped shoulder 111*b* defined therebetween. The closure member 8 has an annular projection 8*a* integrally formed on its outer surface concentric to the axis of the mounting rod 6 and in a face-to-face relation to the cylindrical portion 111*a* of the first presser member 111. The outside diameter of the annular projection 8*a* is substantially equal to that of the small-diameter section of the cylindrical portion 111*a* of the first presser member 111. Slidably mounted over the outer peripheral surfaces of the annular projection 8*a* on the closure member 8 and of the small-diameter cylindrical portion 111*a* of the first presser member 111 is an adjusting ring 118** which has a screw thread formed on the outer peripheral surface thereof.

The second spring means **121*b* such as belleville springs, a coil spring or the like is disposed outside the annular projection 8*a* on the closure member 8 under compression between the outer surface of the closure member 8 and a second annular presser member 119 which is threaded at its inner periphery on the threaded outer peripheral surface of the adjusting ring 118. The second presser member 119 is secured through adjusting bolts 120 to the closure member 8 in a manner such that it is prevented from movement away from the closure member 8 but movable in the direction toward the closure member 8. By turning the adjusting bolts 120 in one or the other direction, the second presser member 119 can be displaced toward or away from the closure member 8 so as to adjust the clearance or distance Gl between the closure member 8 and the second presser member 119, thereby imparting an appropriate initial load to the second spring means 121*b*. In this state the adjusting ring 118 is turnable relative to the second presser member 119 so that the clearance or distance $G_2$ between the outer end (the righthand end in FIG. 5) of the adjusting ring 119 and the stepped shoulder 111*b* of the first presser member 111** is adjustable.

In operation, the second presser member 119 is first set at an appropriate position relative to the closure member 8 by means of the adjusting bolts 120 so that the clearance $G_1$ between the second presser member 119 and the closure member 8 can be properly adjusted to give an appropriate initial load to the second spring means **121*b*. Then, the positions of the coolant tank 3 and hence the superconducting coil (not shown) housed therein are properly adjusted by means of the adjusting nut 12 threaded on the mounting rod 6. Thereafter, by using a turning tool (not shown), the adjusting ring 118 is turned relative to the second presser member 119 so that it is displaced along the outer surfaces of the annular projection 8a on the closure member 8 and the cylindrical portion 111a of the first presser member 111 in a direction toward or away from the closure member 8 to make the clearance G2 between the outer end (the righthand end in FIG. 5) of the adjusting ring 118 and the shoulder 111b of the cylindrical portion 111a of the first presser member 111 equal to the amount of contraction of the coolant tank 3** caused by cryogenic cooling thereof.

In this state, it is to be noted that the first spring means 121a functions such that upon adjustment of the positions of the coolant tank 3 and hence the superconducting coil therein, the coolant tank 3 can be mounted through the heat-insulating support devices $S_4$ of this embodiment to the vacuum vessel 4 by appropriate tensile forces created by the respective first spring means 121a, while on the other hand, when the coolant tank 3 is cooled down to cryogenic temperatures to contract thermally, such a thermal contraction of the coolant tank 3 can be effectively absorbed by the respective first spring means 121a so as to prevent the heat-insulating support members 7 from being subjected to any great tensile forces.

After the thermal contraction of the coolant tank 3, the clearance $G_2$ between the outer end (the righthand end in FIG. 5) of the adjusting ring 118 and the stepped shoulder 111b of the cylindrical portion 111a of the first presser member 111 is reduced to zero whereby the coolant tank 3 is supported to the vacuum vessel 4 through the heat-insulating support member 7 and the mounting rod 6 under the resilient force of the second spring means 121b having a greater spring constant. As a result, large external forces such as eccentric electromagnetic forces created by the superconducting coil (not shown) in the coolant tank 3 are effectively absorbed by the second spring means 121b of the greater spring constant.

Although in the above-described embodiment, the heat-insulating support members 7 are mounted on the coolant tank 3, provision may be made for an intermediate tank storing therein a coolant such as liquid nitrogen or a radiation heat shield which is cooled, for example, by gases vaporized from the liquid nitrogen or liquid helium 2 in the coolant tank 3, and the heat-insulating support member 7 may be mounted on the intermediate tank or the radiation heat shield.

Also, in the above embodiment, although the O ring 14 is disposed between the mounting rod 6 and the closure member 8, it may instead be disposed between the closure member 8 and the cap 13. When the O ring 14 is disposed between the mounting rod 6 and the closure member 8 as in the illustrated embodiment, provision of the cap 13 is optional and may be omitted.

To summarize, according to the present invention, the thermal contraction of the coolant tank upon cryogenic cooling thereof is effectively absorbed by the low spring constant range of the spring means while on the other hand, great external forces acting on the coolant tank are supported or absorbed by the high spring constant range of the spring means. With this construction, it is possible to suppress the displacement of the coolant tank due to an external force within an allowable range, and the heat-insulating support member is subjected only to a minimum load as necessary so that the strengths or the cross sectional areas of the heat-insulating support member and the mounting rod can be accordingly reduced to a minimum, thereby markedly improving the heat insulating capability of the entire device.

What is claimed is:

1. A heat-insulating support device for supporting a coolant tank to a vacuum vessel in a heat insulating manner, said coolant tank being adapted to store a cryogenic coolant and subject to thermal deformation upon cryogenic cooling thereof as well as being subject to large external forces after the cryogenic cooling, said device comprising:

a heat insulating support member disposed outside said coolant tank and having its one end connected with said coolant tank;

a mounting rod having its one end connected with said heat-insulating support member and its other end projected outwardly through said vacuum vessel; and a spring means for resiliently mounting the other projected end portion of said mounting rod on said vacuum vessel, said spring means having a first spring constant for deformations in a first direction having magnitudes less than a first predetermined amount to absorb thermal contraction of said coolant tank and a second spring constant larger than said first spring constant for deformations in said first direction having magnitudes greater than said first predetermined amount to suppress displacement of said coolant tank due to large external forces acting thereon after the thermal contraction of said coolant tank.

2. A heat-insulating support device as set forth in claim 1, wherein said spring means comprises a first spring means of a low spring constant and a second spring means of a high spring constant connected in series with each other.

3. A heat-insulating support device as set forth in claim 2, wherein said first spring means comprises belleville springs, and said second spring means comprises belleville springs having a spring constant larger than that of said first-mentioned belleville springs.

4. A heat-insulating support device as set forth in claim 2, wherein said first spring means comprises single-row belleville springs, and said second spring means comprises miltiple-row belleville springs having a spring constant lager than that of said single-row belleville springs, said multiple-row belleville springs including a plurality of bellville springs disposed in a parallel relation with each other.

5. A heat-insulating support device as set forth in claim 2, wherein said first spring means comprises a coil spring, and said second spring means comprises belleville springs having a spring constant larger than that of said coil spring.

6. A heat-insulating support device as set forth in claim 2, wherein said first spring means comprises a first coil spring, and said second spring means comprises a second coil spring having a spring constant larger than that of said first coil spring.

7. A heat-insulating support device as set forth in claim 2, wherein said first spring means comprises single-row coil springs, and said second spring means comprises miltiple-row coil springs having a spring constant larger than that of said single-row coil springs, said multiple-row coil springs including a plurality of coil springs disposed in a parallel relation with each other.

8. A heat-insulating support device as set forth in claim 2, wherein said first and second spring means comprise the same kind of springs having different spring constants.

9. A heat-insulating support device as set forth in claim 2, wherein said first and second spring means comprise different kinds of springs having different spring constants.

10. A heat-insulating support device as set forth in claim 1, wherein said spring means comprises a first means of a low spring constant and a second spring means of a high spring constant connected in parallel with each other such that after said first spring means has been compressed to a prescribed extent, said second spring means begins to be compressed.

11. A heat-insulating support device for supporting a coolant tank to a vacuum vessel in a heat insulating manner, said coolant tank being adapted to store a cryogenic coolant and subject to thermal contraction upon cryogenic cooling thereof as well as being subject to large external forces after the cryogenic cooling, said device comprising:

a heat-insulating support member disposed outside said coolant tank and having its one end connected with said coolant tank;

a mounting rod having its one end connected with said heat-insulating support member and its other end projected outwardly through said vacuum vessel;

a presser member slidably mounted on said mounting rod;

a spring means disposed between said vacuum vessel and said presser member for resiliently mounting the other projected end portion of said mounting rod on said vacuum vessel, said spring means having a first spring constant for deformations in a first direction having magnitudes less than a first predetermined amount to absorb thermal contraction of said coolant tank and a second spring constant for deformations in said first direction having magnitudes greater than said first predetermined amount to suppress displacement of said coolant tank due to large external forces acting thereon after the thermal contraction of said coolant tank; and an adjusting nut disposed outwardly of said presser member and threadedly engaged with the other projected end of said mounting rod for adjusting an initial load of said spring means.

12. A heat-insulating support device as set forth in claim 11, wherein said vacuum vessel is provided on its outer surface with an outward projection which has a throughhole through which the other end of said mounting rod extends outward, said device further comprising:

a closure member attached to said vacuum vessel for closing said throughhole; and a spring housing mounted on said closure member for receiving therein said spring means.

13. A heat-insulating support device for supporting a coolant tank to a vacuum vessel in a heat insulating manner, said coolant tank being adapted to store a cryogenic coolant and subject to thermal deformation upon cryogenic cooling thereof as well as being subject to large external forces after the cryogenic cooling, said device comprising:

a heat insulating support member disposed outside said coolant tank and having its one end connected with said coolant tank;

a mounting rod having its one end connected with said heat-insulating support member and its other end projected outwardly through said vacuum vessel;

a first presser member slidably mounted on said mounting rod;

a first spring means disposed between said vacuum vessel and said first presser member for resiliently mounting the other projected end portion of said mounting rod on said vacuum vessel for absorbing thermal contraction of said coolant tank;

an adjusting nut disposed outwardly of said presser member and threadedly engaged with the other projected end portion of said mounting rod for adjusting an initial load of said first spring means;

a second presser member mounted on said first presser member for limited sliding movement relative thereto; and a second spring means disposed between said vacuum vessel and said second presser member for suppressing, in cooperation with said first spring means, displacement of said coolant tank due to large external forces acting thereon after the thermal contraction of said coolant tank.

14. A heat-insulating support device as set forth in claim 13, wherein said vacuum vessel is provided on its outer surface with an outward projection which has a throughhole through which the other end of said mounting rod extends outward, and said first presser member has a stepped cylindrical portion having a small-diameter section and a large-diameter section with a stepped shoulder defined therebetween, said device further comprising:

a closure member attached to said vacuum vessel for closing said throughhole and having an annular projection formed on its outer surface in a face-to-face relation with the small-diameter section of said stepped cylindrical portion of said first presser member, said annular projection having an outside diameter substantially equal to that of said small-diameter section;

an adjusting ring slidably mounted over said annular projection on said closure member and the small-diameter section of said stepped cylindrical portion of said first presser member, said adjusting ring having a threaded radially outer surface on which said second presser member in the form of an annular ring is threadedly engaged; and an adjusting bolt means for adjustably securing said second presser member to said closure member in a manner such that said second presser member is movable toward said closure member but prevented from movement away from said closure member, said adjusting bolt means serving to adjust an initial load of said second spring means;

whereby by turning said adjusting ring relative to said second presser member, a clearance between one end of said second presser member and the stepped shoulder on said stepped cylindrical portion of said first presser member can be appropriately adjusted.

15. A heat-insulating support device as set forth in claim 13, wherein said second spring means has a spring constant greater than that of said first spring means.

* * * * *